US005551556A

United States Patent [19]

Sutherland

[11] Patent Number: 5,551,556

[45] Date of Patent: Sep. 3, 1996

[54] WRAP-AROUND CARRIER WITH BAR CODE BLOCKING END PANELS

[75] Inventor: Robert L. Sutherland, Kennesaw, Ga.

[73] Assignee: Riverwood International Corporation, Atlanta, Ga.

[21] Appl. No.: 490,480

[22] Filed: Jun. 14, 1995

[51] Int. Cl.[6] ..... B65D 75/00

[52] U.S. Cl. ..... 206/147; 206/427

[58] Field of Search ..... 206/139, 140, 206/141, 145, 147, 427, 434

[56] References Cited

U.S. PATENT DOCUMENTS

| | | | |
|---|---|---|---|
| 3,963,121 | 6/1976 | Kipp | 206/434 |
| 4,215,781 | 8/1980 | Humphries et al. | 206/434 |
| 5,180,054 | 1/1993 | Bakx | 206/140 |
| 5,297,673 | 3/1994 | Sutherland | 206/147 |

*Primary Examiner*—Jacob K. Ackun

[57] ABSTRACT

A wrap-around carrier including partial upper and lower end panels. Partial lower end panel flaps are locked in place by side panel locking flaps extending between an adjacent end article and a connected side panel. They are further held in place by either gusset panels connected to the bottom panel or a mechanical interconnection. Webs may be provided between the lower end panel flaps and upper gusset panels to contact the curved surface of adjacent packaged articles.

4 Claims, 7 Drawing Sheets

WRAP-AROUND CARRIER WITH BAR CODE BLOCKING END PANELS

FIELD OF THE INVENTION

This invention relates to wrap-around article carriers. More particularly, it relates to wrap-around carriers which include partial end panels capable of blocking the pricing code printed on the end articles in the carrier.

BACKGROUND OF THE INVENTION

Certain types of articles, such as food or beverage containers, are commonly sold either as individual units or in a multi-container carton. Each article is normally marked with a bar pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred to provide wrap-around carriers with partial end panels of a size sufficient to cover the pricing code on the end articles in the package. Such a design requires less stock than a fully enclosed carrier and is correspondingly more economical to produce. Ideally, the partial end panels should be large enough to cover the pricing code of the end articles, should not interfere with the normal fabrication and packaging methods of wrap-around carriers and should be locked in place after being formed.

The main object of the invention, therefore, is to provide a wrap-around carrier with an improved partial end panel design which covers the pricing code of end articles and also prevents outward movement of the articles.

BRIEF SUMMARY OF THE INVENTION

The invention is embodied in a package formed of a carrier of basic wrap-around design containing a plurality of rows of adjacent articles. In one aspect of the invention upper end panel flaps are connected to the top panel and lower end panel flaps are connected to the side panels. An upper gusset panel is foldably connected to the ends of each upper end panel flap and a locking flap is situated between, and is foldably connected to, the upper gusset panels and the lower end panel flaps. At least a portion of each locking flap extends between the adjacent end article and the associated side panel, and at least a portion of each upper gusset panel extends between the adjacent end article and the associated locking flap.

By this arrangement partial end panels are provided at the top and bottom of a package and are held in place due to the locking panel being pinched between the side panel and the adjacent article. The locking flaps preferably are foldably connected to associated lower end panel flaps by a web capable of being in substantial contact with the curved surface of an adjacent article.

The lower end panel flaps are also maintained in position by additional locking means. In one embodiment they are connected to lower gusset panels, each of which is designed and connected to the associated bottom panel flap in such a way as to divide the lower gusset panels into two segments, so that one segment overlies the other segment, with portions of both segments situated between an adjacent article and the bottom panel. In another arrangement the lower end panel flaps are mechanically locked together at their end portions.

In another aspect of the invention, regardless of whether upper end panel flaps are provided, the cooperative arrangement of the locking flaps and the lower gusset panels serve to hold the lower end panel flaps in place in a unique and highly effective manner.

The carrier accomplishes the purpose of covering the pricing code on end articles in a wrap-around carrier, and does so economically by means which prevent outward movement of the packaged articles.

The above and other aspects and benefits of the invention will readily be apparent from the more detailed description of the preferred embodiment of the invention which follows.

DETAILED DESCRIPTION OF THE PREFERRED EMBODIMENTS

Figure 1:
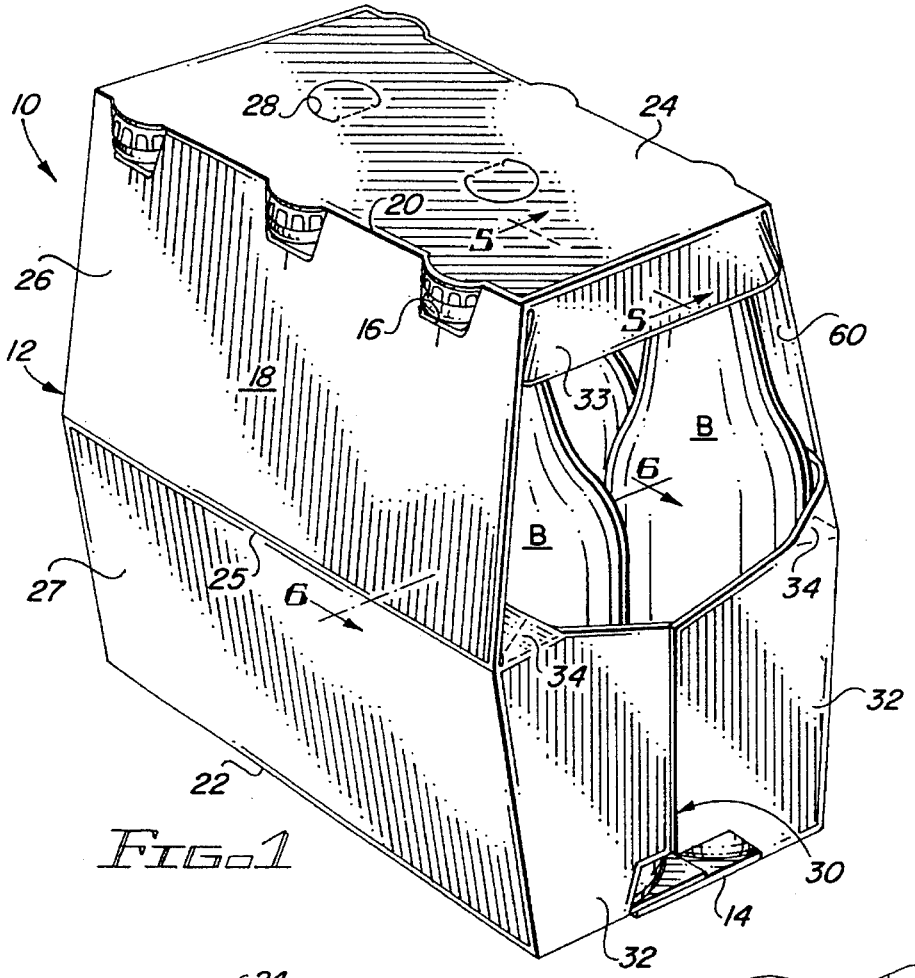
FIG. 1 is a pictorial view of one embodiment of the carrier of the invention.

Referring to FIG. 1, a package 10 is comprised of wrap-around carrier 12 containing six beverage bottles B which are supported on the bottom panel 14 of the carrier. The top outer portions of the bottles protrude through openings 16 in side panels 18, which are connected by fold lines 20 and 22 to the top panel 24 and the bottom panel 14, respectively. An intermediate score line 25 divides the side panels into upper and lower outwardly sloping sections 26 and 27, which enables the side panels to closely follow the shape of adjacent bottles. Finger holes 28 in the top panel are provided for use as a handle when lifting the package. Partial end panels 30, comprised of overlapping end panel flaps 32 which are connected to both the side panels and the bottom panel, extend up a sufficient distance to conceal the portion of the bottles containing the pricing code, and upper end panel flap 33 extends down from the top panel for a short distance. In addition, restraining webs or segments 34 extend from the end panel flaps 32 toward the side panels so as to contact the crown portions of the end bottles. The end panel flaps 32 are locked in place by a mechanism in the interior of the carrier which is explained in detail hereinafter.

Figure 2:
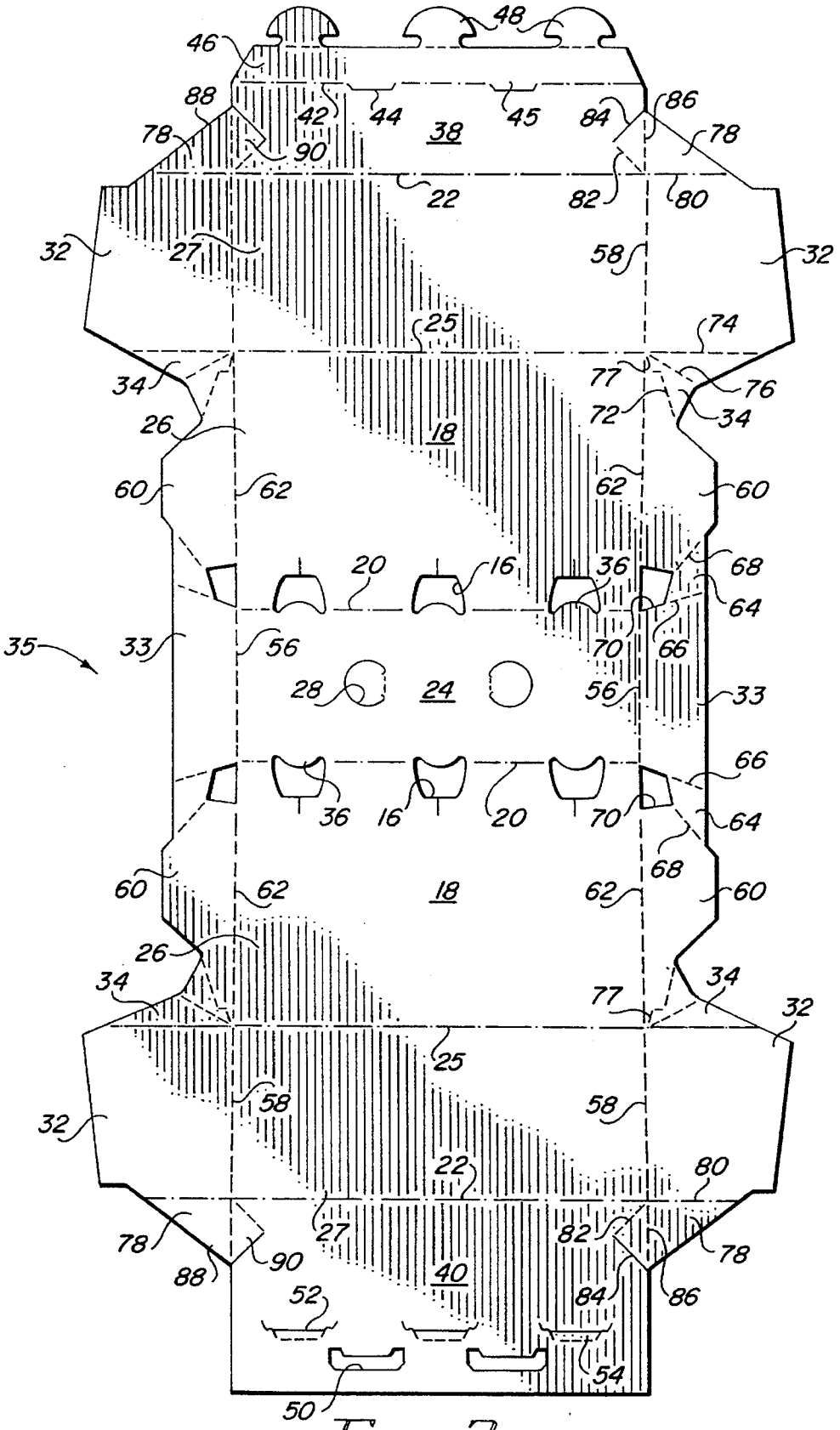
FIG. 2 is a plan view of a blank used to form the carrier of FIG. 1.

Referring now to FIG. 2, wherein like reference numerals to those used in FIG. 1 denote similar elements, a blank 35 capable of being fabricated into the carrier of FIG. 1 is comprised of a central top panel section 24 connected at opposite sides along the score lines 20 to side panel sections 18. The score lines 20 are interrupted by the edges of the cutouts 16 which form tabs 36 that overlie the projecting portions of bottle caps in a carrier.

The score lines 22 connect the side panel sections 18 to bottom panel flaps 38 and 40. The bottom panel flap 38 includes a fold line 42 which, except for being interrupted by slits 44 which form primary locking tabs 45, extends the full length of the flap. Extending outwardly of the fold line 42 is a locking panel flap 46 which includes outwardly extending secondary locking tabs 48. The bottom panel flap 40 includes cutouts having primary female locking edges 50 adapted to engage the primary male locking tabs 45 and slits 52 adapted to receive the secondary locking tabs 48. Foldably connected tabs or flaps 54 in the bottom panel flap 40 may be provided to facilitate entry of the locking tabs 48 into the slits 52. Although these various locking elements are illustrated to demonstrate a typical bottom panel locking arrangement suitable for use with the carrier of the invention, it should be understood that any desired effective form of bottom panel locking means may be employed.

The upper end flaps 33 are connected to the end edges of top panel section 24 by fold lines 56, while the lower end panel flaps 32 are connected by fold lines 58 to the end edges of the lower side panel sections 27. Extending between the end flaps 33 and the end panel flaps 32 are side panel locking flaps 60 which are connected by fold lines 62 to the end edges of the upper side panel sections 26. Gusset panels 64 are connected to opposite sides of the end flaps 33 by fold lines 66 and to the locking flaps 60 by fold lines 68. The fold lines 66 and 68 extend toward the intersection of the fold lines 20 and 56, but are interrupted by cutouts 70 which facilitate folding of the gusset panels by removing material which would otherwise bunch together.

The webs 34 are connected to the locking flaps 60 by fold line 72 and to the end panel flaps 32 by fold line 74. An intermediate fold line 76 is also provided, extending at an angle to both the fold lines 72 and 74. The fold lines 74 and 76 meet at the intersection of the fold lines 25 and 58. The fold line 72 is angled toward a point slightly spaced from the intersection of fold lines 74 and 76, and is connected to that point of intersection by short slit 77. Lower gusset panels 78 are connected to the opposite side of the end panel flaps 32 by fold lines 80, which are substantially continuations of the score lines 22, and to bottom panel flaps 38 and 40 by angled fold lines 82. The gusset panels 78 include two free edges, one extending to the bottom panel flaps 38 and 40 and the other being formed by angled slit 84 in the bottom panel flaps. The fold line 82 and the slit 84 of each gusset panel 78 intersect at a point within the bottom panel flaps. An intermediate fold line 86, which is substantially a continuation of the fold line 58, extends across the gusset panels 78, terminating at the corner formed by the intersection of the two free edges of the gusset panels 78. The fold line 58 thus divides the gusset panel 78 into two segments, an outer segment 88 and an inner segment 90.

Figure 3:
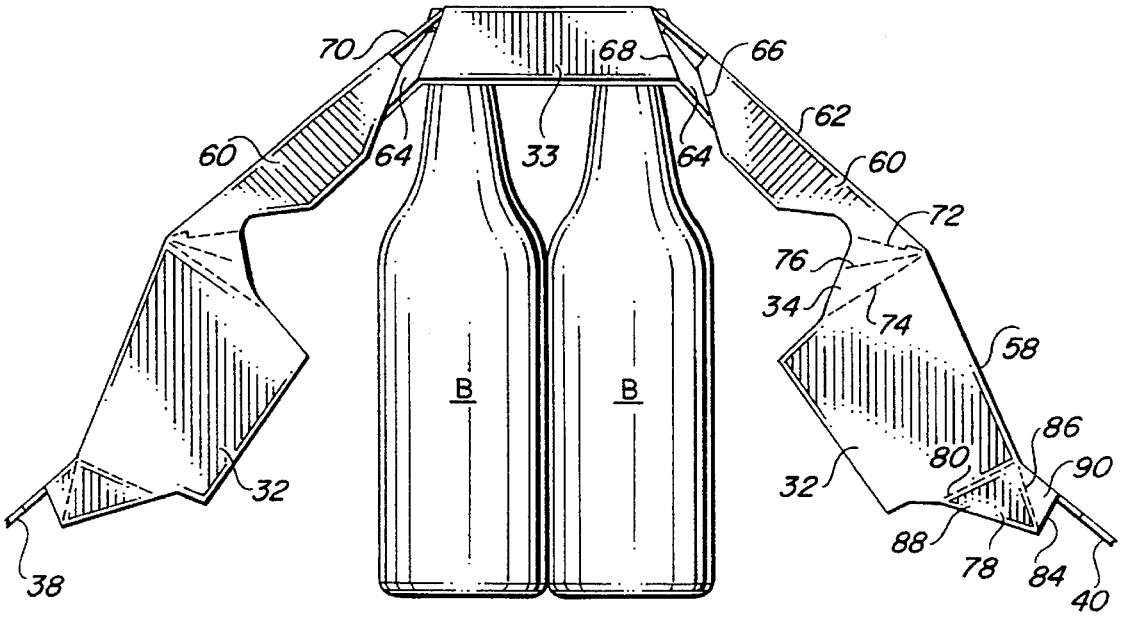
FIG. 3 is an end view of the blank in an initial stage of carrier formation after being placed on a group of bottles and initially folded.

To form a package of bottles, the bottles are grouped together as they are to be arranged in the package and the top panel section of the blank is aligned with the bottles and placed on top of them. The blank is then folded down about the score lines 20. As this step takes place the locking flaps 60 are folded in along their fold lines 62. Inward movement of the locking flaps 60 moves the fold lines 68 and 72 inwardly, which pulls the upper gusset panels 64 and the web segments 34 inwardly also. This action folds the gusset panels 64 up out of the plane of the blank, which pulls the upper end flaps 33 down, as illustrated in the interim position of the blank shown in FIG. 3. Also, the bottom panel flaps 38 and 40 are folded back a short distance, which together with the folding of the end panel flaps 32 causes the gusset panels 78 to fold inwardly about the fold line 86. Note that the edge 84 of the gusset panels 78 has moved away from the bottom panel flaps in response to this force, allowing the inward folding to take place.

Figure 4:
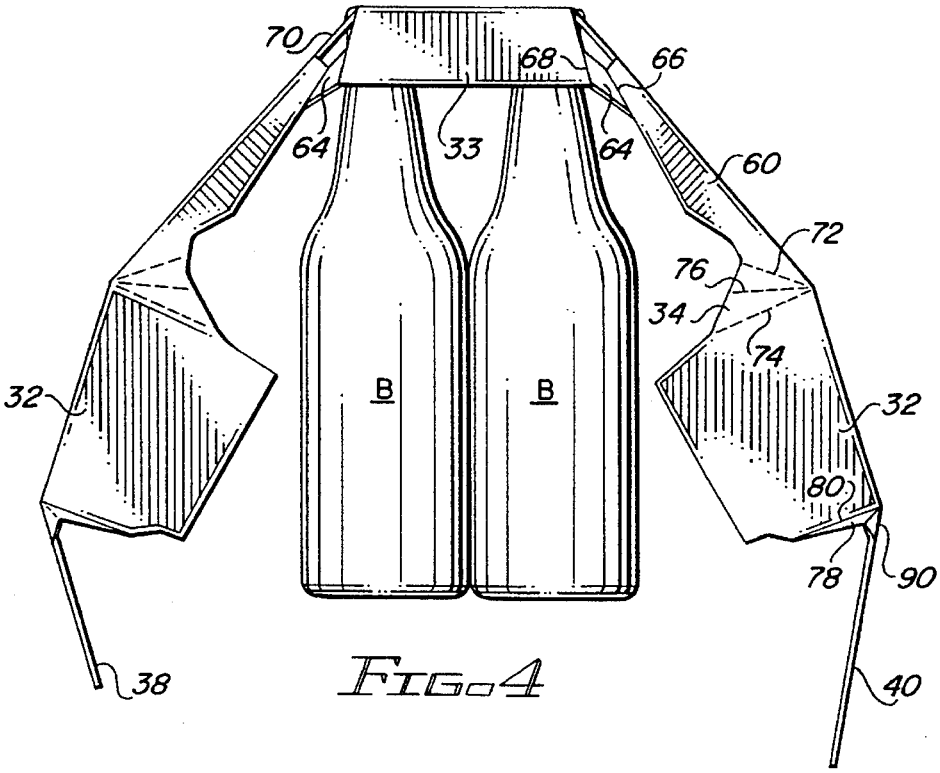
FIG. 4 is an end view similar to that of FIG. 3, but showing the blank at a later point in the process of carrier formation.

As the folding process continues, the bottom panel flaps 38 and 40 are pivoted down. Due to the previously initiated inward folding of the gusset panels 78, the downward movement of the bottom panel flaps causes the inward folding of the gusset panels 78 to be completed, with the gusset panel segments 90 folding up beneath the gusset panel segments 88. FIG. 4 illustrates the blank at a point in the carrier forming process where the folding of the bottom panel flaps has begun and the folding of the gusset panels 78 has been substantially completed.

Figure 5:
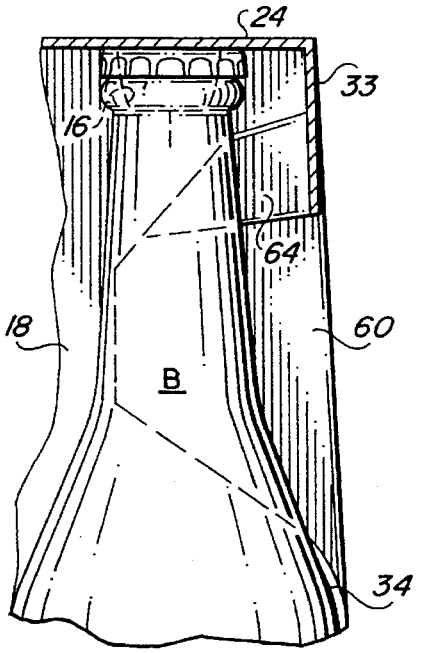
FIG. 5 is an enlarged partial sectional view taken along line 5—5 of FIG. 1.

As the bottom panel flaps are folded about the fold lines 22, the side panel locking flaps 60 move toward their final position, in which they lie substantially flat against the connected side panel, and the gusset panels 64 are folded in so as to lie flat against the associated locking flap 60 between the adjacent bottle neck and the side panel. This arrangement is illustrated in FIG. 5. Because the locking flaps 60 are locked in place between the side panels and the bottles, the upper end flaps 33 and the webs 34 are similarly tightly held in place. As shown in FIG. 1, the fold lines forming the webs 34 allow the web segments to be pulled tightly into contact with the bottle crowns, allowing the webs to substantially conform to the shape of the bottles in this area.

Figure 6:
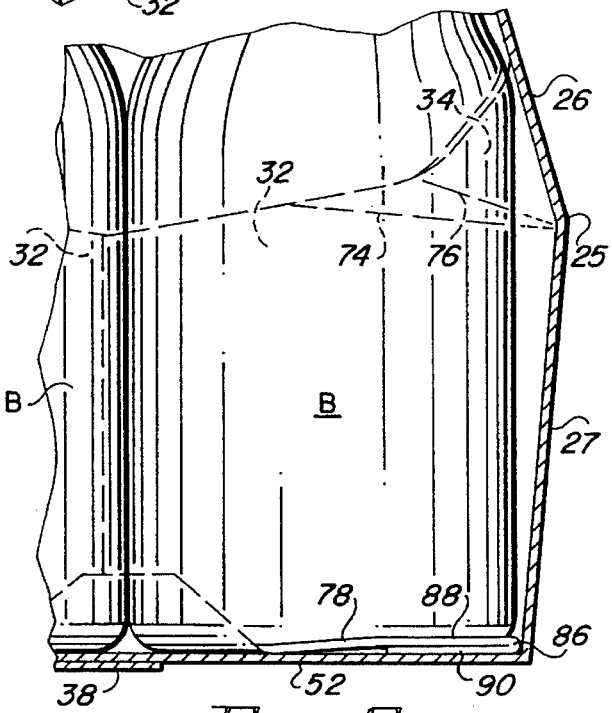
FIG. 6 is an enlarged partial sectional view taken along line 6—6 of FIG. 1.

In addition, as the bottom panel flaps are folded about the fold lines 22 and the end panel flaps 32 are pivoted in toward their closed position, the gusset panel segments 90 are folded flat against their associated bottom panel flaps and the segments 88 extend inwardly at right angles to the end panel flaps, overlying the gusset panel segments 90 in face-to-face contact. Both gusset panel segments 88 and 90 are thus located between the bottom of the adjacent bottle and the associated bottom panel flap, as best illustrated in FIG. 6. The weight of the end bottles on the gusset panel segments locks the segments in place, thereby holding the end panel flaps in their final position. The end panel flaps are thus locked in final position by both the locking flaps 60 and the gusset panels 78. Since the bottles are contacted by the end panels at their crowns as well as at their bottom portions, they are held substantially immovable in the carrier. In addition, the upper end flaps 33 prevent any movement by the upper portion of the bottles beyond the confines of the upper end flaps.

The final step in the formation of the package is to lock the bottom panel flaps together. The details of this phase of the operation have not been illustrated since the particular locking mechanism employed does not form part of the invention. It will be understood by those familiar with the locking elements shown, however, that the locking panel 46 of the bottom panel flap 38 is folded back about the fold line 42 and the primary male locking tabs 45 are engaged with the primary female locking edges 50 in bottom panel flap 40. The secondary male locking tabs 48 are then inserted through the slits 52 to complete the mechanical locking action, resulting in the package of FIG. 1.

Although it may be considered to be a matter of choice depending on the particular shape of the webs 34, it is preferred to include the short slit 77 at the end of the web fold line 72. This arrangement facilitates the inward folding of the web along the fold line 72 which could otherwise be hampered by the bunching of the blank material at the area adjacent the intersection of the fold lines 72, 74, 76, 58 and 62. It is also preferred to incorporate the cutouts 70 in order to eliminate material which would otherwise tend to bunch together when the gusset panels 64 are folded. The size of the cutouts may vary, but should not be so large as to leave the gusset panel fold lines too short to withstand the stresses to which they are subjected when pulling the upper end flaps 33 into place.

While the various folding steps described can be done by hand it is contemplated that they would be carried out in a packaging machine as the cans and blank are continuously moving through the machine. In that event the locking panel flaps 60 and the gusset panel segments 88 and 90 would be engaged and moved by suitable packaging machine elements in order to fold the locking panel flaps and the locking gusset panels. Neither the packaging machine nor the folding elements of the machine have been shown since the various mechanical movements required in order to fold the panels of a carrier into place are well within the scope of one skilled in the packaging machine art.

Figure 7:
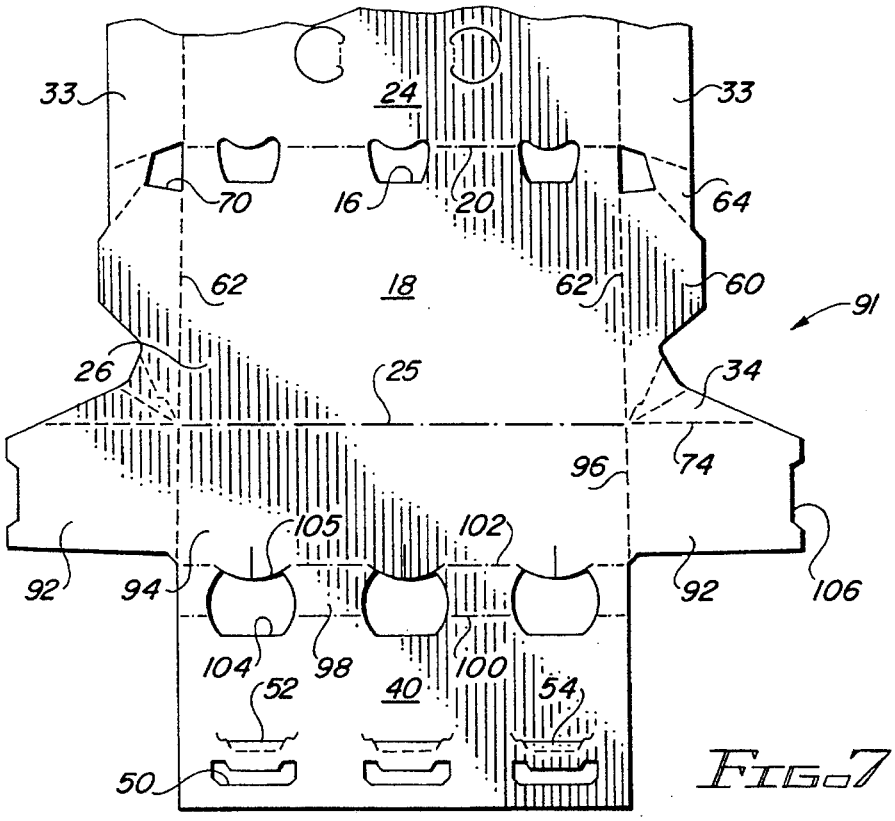
FIG. 7 is a partial plan view of a blank for forming another carrier embodiment of the invention.

Referring now to FIG. 7, a blank 91 for forming a different version of the carrier of FIG. 1 is shown. Only half of the blank is illustrated since the other half is the same as the half shown except for the provision of a bottom panel flap substantially identical to the bottom panel flap 38 of the blank 35. In the blank 91 the top panel section 24, upper side panel section 26, locking panel 60, gusset panel 64, web 34 and bottom panel flap 40 are similar to the corresponding elements of the same reference numerals shown in FIG. 2. In this arrangement, however, there are no gusset panels corresponding to the gusset panels 78 of FIG. 2. The end panel flaps 92 are connected only by fold line 74 to the web 34 and by fold line 96 to the lower side panel section 94. In addition, in this arrangement the bottom panel flap 40 is not connected directly to the side panel section, but to a sloped heel panel section 98 by fold line 100. The heel panel section in turn is connected to the lower side panel section 94 by fold line 102. Heel cutouts 104 extend from slits 105 which interrupt the fold line 102, through the heel panel section 98 and into the bottom panel flap 40. The ends of the end panel flaps 92 include a recess or notch 106, while the ends of the end panel flaps which are not shown have a correspondingly shaped tab.

The process of folding the blank 91 to create a package is the same as described in connection with the carrier of FIG. 1, except that there are no lower gusset panels to fold. This results in the carrier shown in FIG. 8, wherein the locking flaps 60 hold the end panel flaps 92 in folded condition. The heel portions of the bottles are held against movement by the bite between the edges of the heel cutouts 104 and the bottles. This combination of restraints against bottle movement is sufficient to keep the package intact and make it safe to carry. This more simplified arrangement is beneficial in reducing the cost of the carrier by reducing or simplifying the required carrier forming steps. Although the folded webs 34 serve to adequately hold the end panel flaps in place, it is preferred to additionally provide for mechanically locking the ends of the flaps together. The end panel flap design illustrated in FIGS. 7 and 9 provides this function. As shown in FIG. 9, the end panel flaps 92' which are in the half of the blank not shown in FIG. 7, include a tab 108. The tab 108 fits beneath the flap 92 so that the outer end edges 110 of the flap 92' are aligned with the recessed edge 112 of the flap 92 to make a neat finished appearance. Although the end panel flaps do not extend all the way down to the bottom panel, they extend down far enough to cover the pricing bar code on the end bottles.

Figure 10:
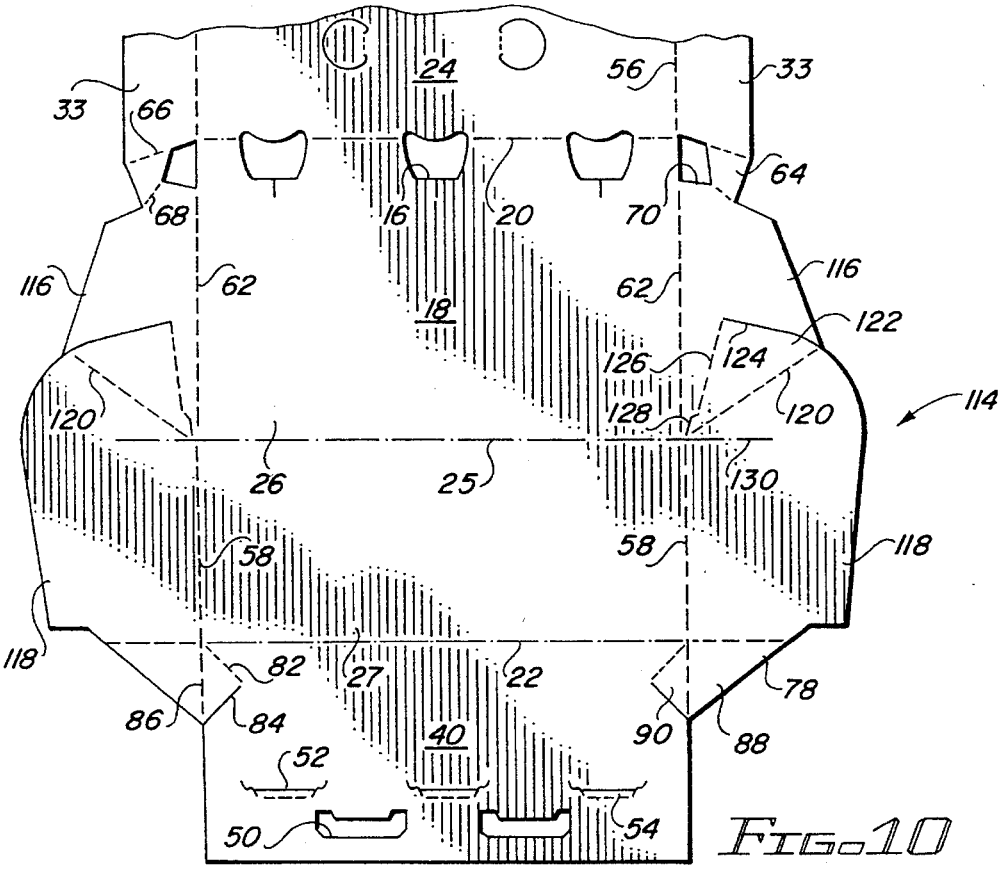
FIG. 10 is a partial plan view of a blank for forming another carrier embodiment of the invention.

A blank 114 for forming a carrier which has the same type of locking features as the carrier of FIG. 1 but has a different end panel design is shown in FIG. 10. All the elements of the blank 114 which bear the same reference numerals as those used in FIG. 2 refer to the same elements. The difference is in the design of the locking panels and the end panel flaps. In FIG. 10 the locking flaps 116 and the end panel flaps 118 are connected to the upper and lower side panel sections 26 and 27 by fold lines 62 and 58, respectively, in the same manner as the locking flaps 60 and the end panel flaps 32 of the blank of FIG. 2. Instead of the end panel flaps being connected to the locking flaps by a web formation, as in FIG. 2, the end panel flaps 118 are connected to the locking flaps 116 by an arrangement which can be considered a modified web. The end panel flaps 118 extend up beyond the fold line 25 to connect with the locking flaps 116 by a diagonal fold line 120. A web 122 is formed by the fold line 120, slit 124 and fold line 126. Preferably, a short slit 128, comparable to the short slit 77 of the blank of FIG. 2, is provided to connect the end of the fold line 126 to the intersection of the fold lines 120, 62 and 58. The slit 124 is essentially an extension of the upper edge of the end panel flap 118. In addition, each end panel flap 118 includes a score line 130 which extends partially across the width of the flap. The score lines 130 are extensions of the score line 25.

Figure 11:
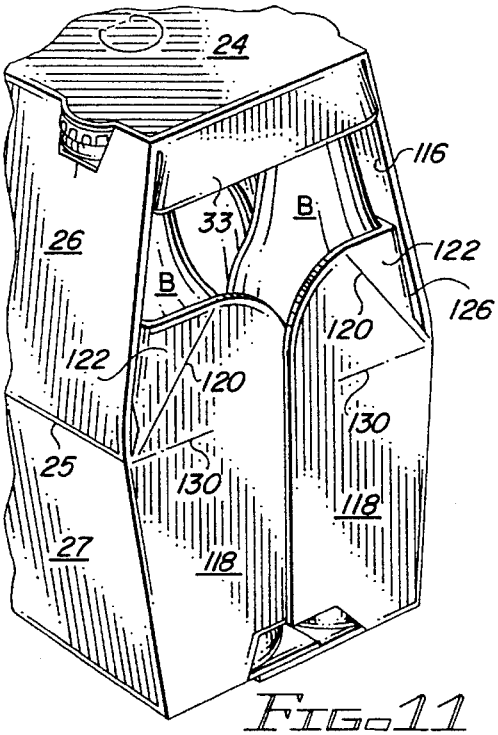
FIG. 11 is a partial pictorial view of a carrier formed from the blank of FIG. 10.

A carrier is formed from the blank 114 the same way as a carrier is formed from the blank of FIG. 2, resulting in the carrier illustrated in FIG. 11. The upper edge of the webs 122 corresponds to the slit 124 in the blank of FIG. 10, and the webs are folded back from the locking panels along the fold lines 126. The score lines 130 allow the upper portion of the end panel flaps to bulge outward slightly as dictated by the curvature of the end bottles, thereby providing close conformation of the end panels to the bottles. This embodiment provides for more of the end bottles to be covered, offering a somewhat more finished appearance, while still providing only partial end panels. The locking features holding the end panel flaps in place function the same as in the carrier of FIG. 1.

Figure 12:
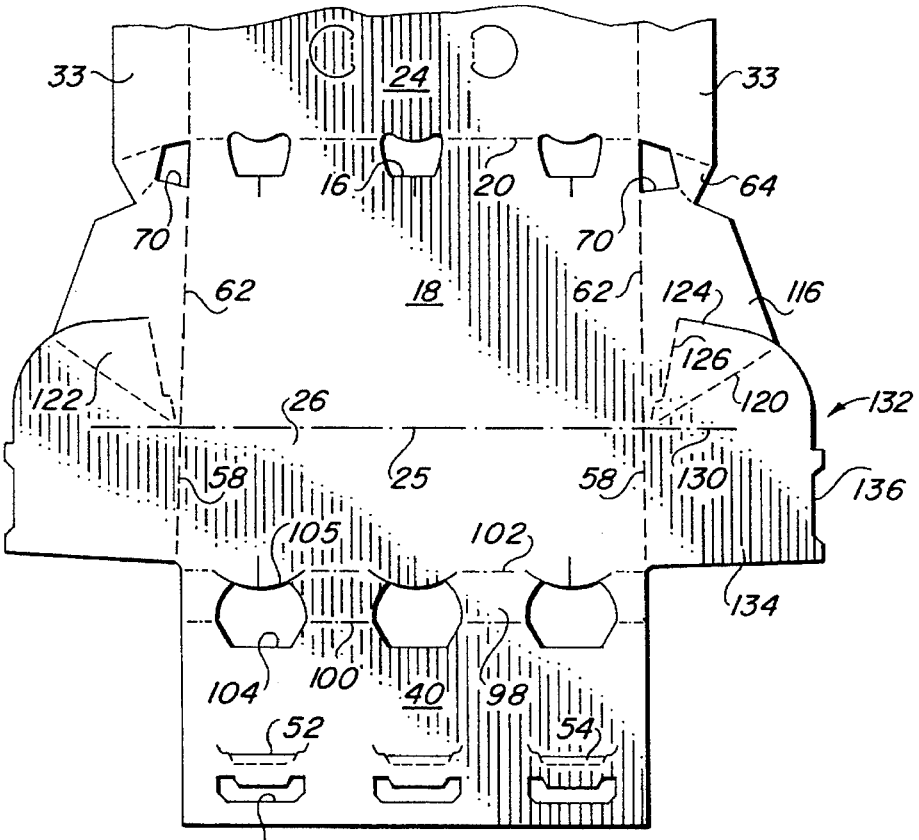
FIG. 12 is a partial plan view of a blank for forming another carrier embodiment of the invention.

A modified arrangement of the carrier of FIG. 11 is formed from the blank 132 of FIG. 12. The portions of the blank common to the blank of FIG. 10 retain the same reference numerals, as do the portions of the blank common to the blank of FIG. 7. The blank contains features which provide end panel flaps similar in shape to the end panel flaps of FIG. 10, but which are held in place in the manner of the end panel flaps of FIG. 7. Thus the blank includes heel panel sections 98, heel cutouts 104 and end panel flaps 134 which are not connected to the bottom panel flaps. As in the blank of FIG. 7, the end panel flaps shown have end edges which are notched or recessed at 136, while the end edges of the end panel flaps in the other half of the blank have tabs. The blank is formed into a carrier as described in connection with the blank of FIG. 7, producing the carrier of FIG. 13, with the end panel flaps 134 being mechanically locked together as in the carrier of FIG. 8.

Figure 14:
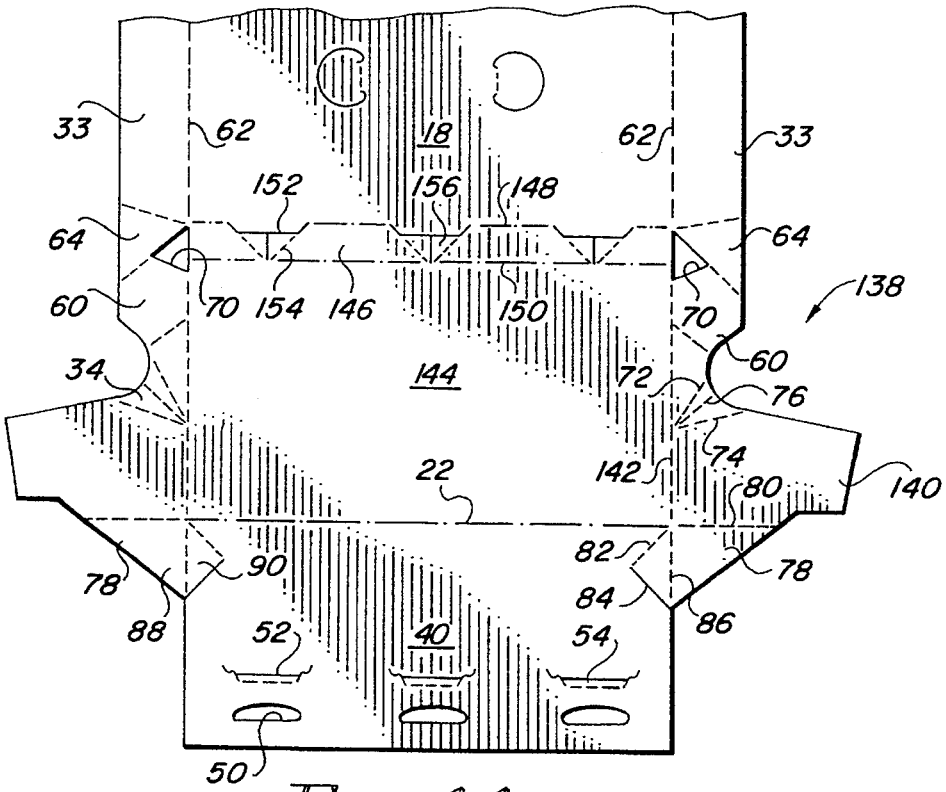
FIG. 14 is a partial plan view of a blank for forming another carrier embodiment of the invention.

Another embodiment of the invention is in a form especially suitable for packaging cans. Referring to FIG. 14, except for the dimensions, the design of the elements of blank 138 is similar to the design of the blank of FIG. 2, including gusset panels 64 and 78 and locking panels 60. The end panel flaps 140 are connected by fold lines 142 to the side panel sections 144. A shoulder panel section 146 lies between the side panel sections 144 and the top panel section 18. Fold lines 148 connect the shoulder panel sections to the top panel and fold lines 150 connect the shoulder panel sections to the side panel sections. Cutouts in the shoulder panels formed by slits 152 and the fold lines 154 of flaps 156 allow the top rims or flanges of the cans to protrude out for a short distance.

Figure 15:
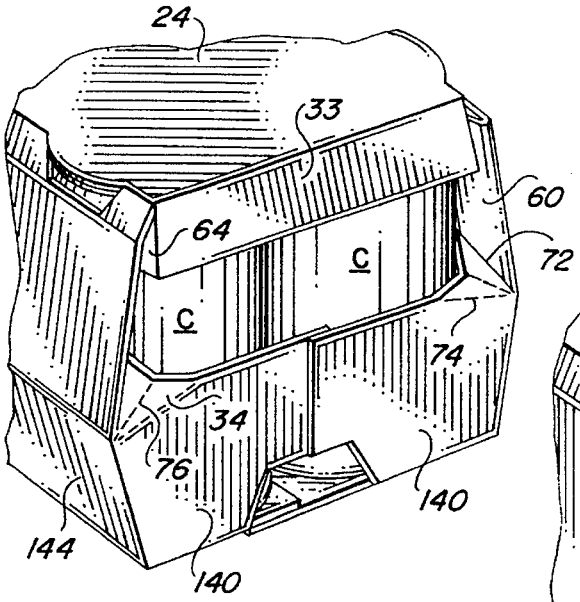
FIG. 15 is a partial pictorial view of a carrier formed from the blank of FIG. 14.

The carrier of FIG. 15 is produced from the blank 138 in the same manner as the carrier of FIG. 1 is produced from the blank of FIG. 2. Due to the low height of the carrier and the shape of the cans C, there is no need in this design for a score line comparable to the score line 25 of the carrier of FIG. 1. The absence of such a score line does not adversely affect the formation of the webs 34.

Figure 8:
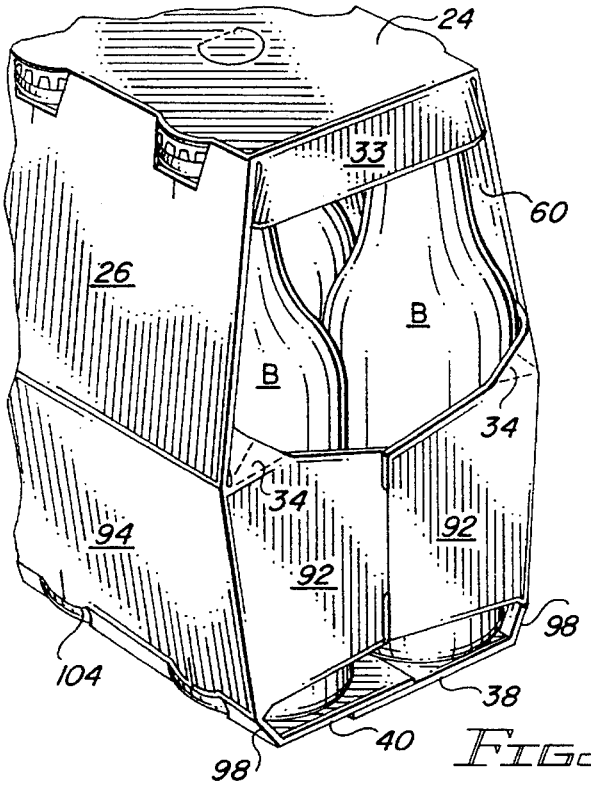
FIG. 8 is a partial pictorial view of a carrier formed from the blank of FIG. 7.
Figure 9:
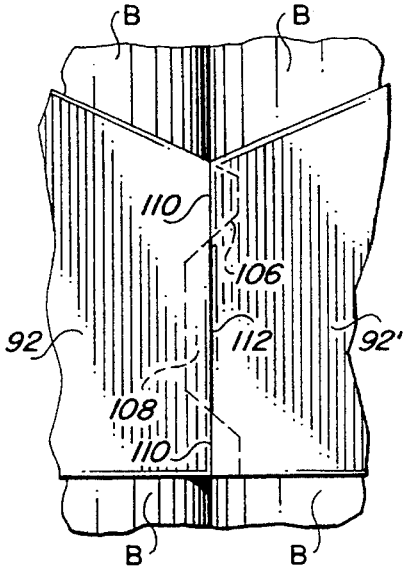
FIG. 9 is an enlarged partial elevational view of the end panel flaps of the carrier of FIG. 8, illustrating the manner in which they are locked together.
Figure 13:
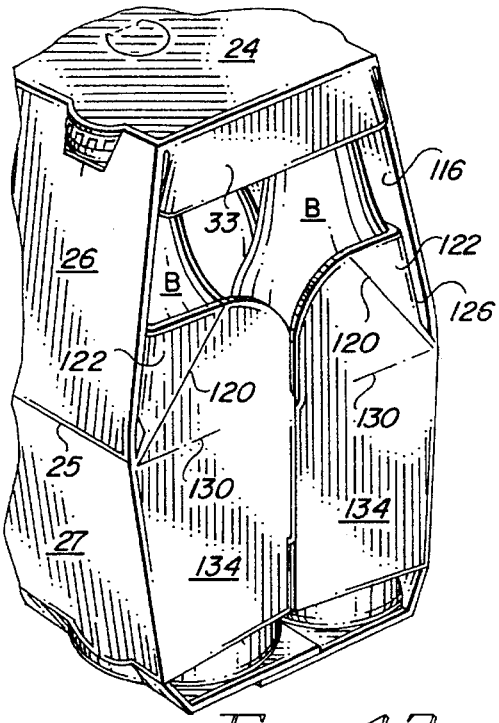
FIG. 13 is a partial pictorial view of a carrier formed from the blank of FIG. 12.
Figure 16:
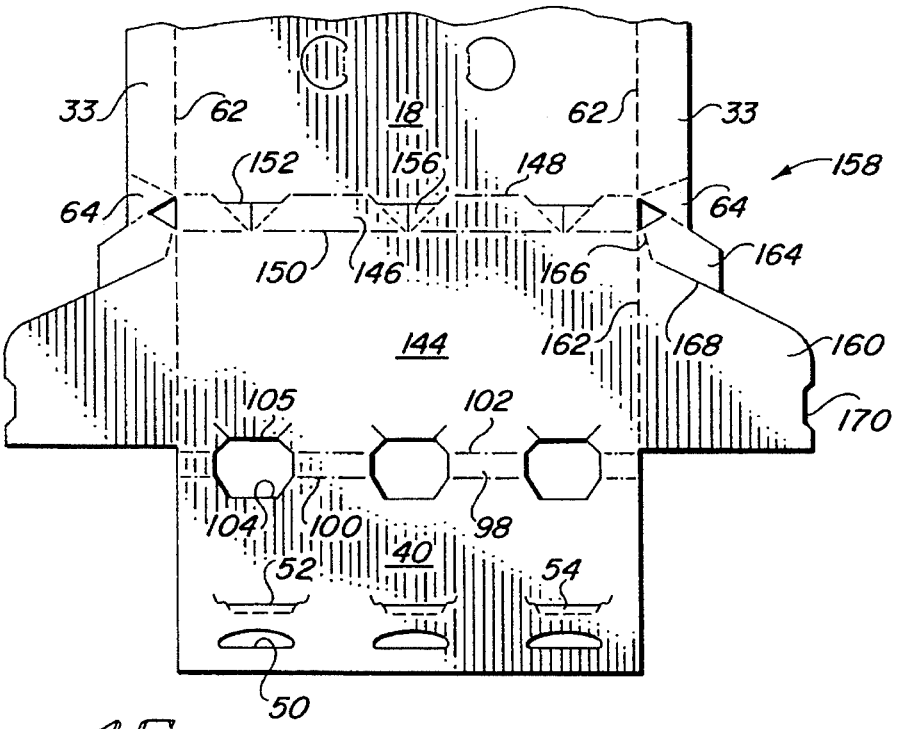
FIG. 16 is a partial plan view of a blank for forming another carrier embodiment of the invention.

The carrier of FIG. 15 may also be modified to eliminate the connection between the end panel flaps and the bottom panel flaps as in the carriers of FIGS. 8 and 13. The blank 158 of FIG. 16 illustrates such a modified design. The blank 158 includes a shoulder panel section 146 as in the blank of FIG. 14 and a heel panel section 98 as in the blank of FIG. 12. Unlike the blanks of FIGS. 7 and 12, the blank 158 does not include a web connection between the locking flap and the associated end panel flap. Thus the end panel flaps 160 are connected to the side panel sections 144 along the fold lines 162, while the locking flaps 164 are connected to an upper leg of the end panel flaps 160 along the fold lines 166. The locking panels are separated from the adjacent end panel flap 160 by a slit 168, which is a continuation of the upper edge of the end panel flap 160. The ends of the end panel flaps shown are provided with a notch or recess 170, and the ends of the end panel flaps not shown are provided with tabs as explained above.

Figure 17:
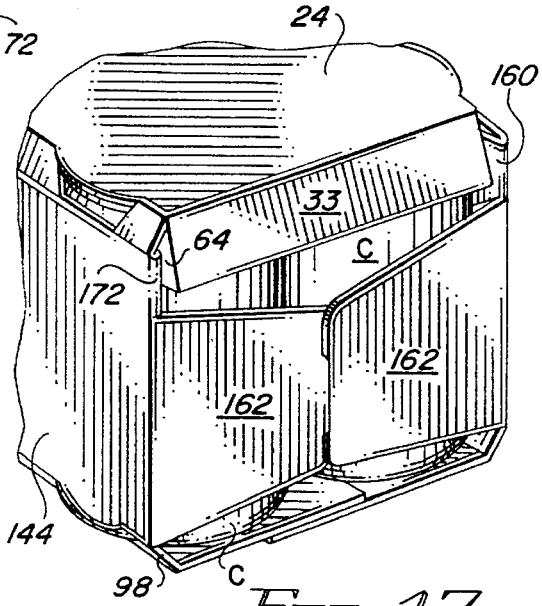
FIG. 17 is a partial pictorial view of a carrier formed from the blank of FIG. 1.

The blank 158 is formed into the carrier of FIG. 17 in the same manner as described in connection with the carriers of FIGS. 8 and 13. The locking panels 164, although short, are capable of pulling the end panel flaps into place and of folding in between the side panels and the end cans in the carrier. Webs are not provided in this design since the posts 172 formed by the legs extending up between the fold lines 162 and 166, as well as the upper end flaps 33, prevent outward movement of the cans. In addition, the bite between the cutouts in both the shoulder panels and the heel panels assist in preventing can movement.

Although the invention has been described in connection with a carrier designed to hold bottles or cans, it obviously may be incorporated in carriers designed to hold more or less than that and can be utilized with other types of articles of various sizes. It can be appreciated that the folding of the locking flaps activates the folding of the upper end flaps, the gusset panels, the webs and the end panel flaps, thereby automatically moving the end panel flaps into place. The carriers are economical, simple to fabricate, provide end restraints against outward movement of the articles and cover the bar code on the end articles to prevent inadvertent price scanning.

It should now be apparent that the invention is not necessarily limited to all the specific details described in connection with the preferred embodiments, but that changes to certain features of the preferred embodiments which do not alter the overall basic function and concept of the invention may be made without departing from the spirit and scope of the invention as defined in the appended claims.

What is claimed is:

1. A package comprised of a wrap-around carrier containing a plurality of rows of adjacent articles, comprising:

opposite side panels connected to top and bottom panels, the bottom panel being comprised of a first bottom panel flap connected to a second bottom panel flap, the top panel, each bottom panel flap and each side panel having opposite end edges;

an upper end panel flap connected to each of the end edges of the top panel, the upper end panel flaps having opposite ends;

a lower end panel flap connected to each of the end edges of the side panels;

each opposite end of each upper end panel flap being connected by a fold line to an upper gusset panel;

a locking flap between each upper gusset panel and each associated lower end panel flap, the locking flap being foldably connected to the associated upper gusset panel and to the associated lower end panel flap;

at least a portion of each locking flap extending between, and being in contact with, the adjacent end article and the associated side panel; and at least a portion of each upper gusset panel extending between the adjacent end article and the associated locking flap;

the lower end panel flaps at each end of the carrier having end portions which mechanically interlock with each other.

2. A blank for forming a carrier for packaging a plurality of rows of adjacent articles, comprising:

a sheet having a centrally located top panel section, the top panel section having opposite end edges;

a side panel section connected to opposite sides of the top panel section by a fold line, the side panel sections having opposite end edges;

a bottom panel flap connected to each side panel section by a fold line;

an upper end panel flap connected by a fold line to each of the end edges of the top panel section, the upper end panel flaps having opposite ends;

a lower end panel flap connected by a fold line to each of the end edges of the side panel sections;

each opposite end of each upper end panel flap being connected by a fold line to an upper gusset panel; and a locking flap between each upper gusset panel and each associated lower end panel flap, the locking flap being foldably connected to the associated upper gusset panel and to the associated lower end panel flap;

at least a portion of each locking flap extending between, and being in contact with, an adjacent end article and the associated side panel in a carrier formed from the blank, and at least a portion of each upper gusset panel extending between an adjacent end article and the associated locking flap in such a carrier;

the lower end panel flaps including means for mechanically interconnecting with associated lower end panel flaps in a carrier formed from the blank.

3. A blank for forming a carrier for packaging a plurality of rows of adjacent articles, comprising:

a sheet having a centrally located top panel section, the top panel section having opposite end edges;

a side panel section connected to opposite sides of the top panel section by a fold line, the side panel sections having opposite end edges;

a bottom panel flap connected to each side panel section by a fold line;

an upper end panel flap connected by a fold line to each of the end edges of the top panel section, the upper end panel flaps having opposite ends;

a lower end panel flap connected by a fold line to each of the end edges of the side panel sections;

each opposite end of each upper end panel flap being connected by a fold line to an upper gusset panel;

a locking flap between each upper gusset panel and each associated lower end panel flap, the locking flap being connected to the associated upper gusset panel by a first locking flap fold line and to the associated lower end panel flap by a second locking flap fold line;

at least a portion of each locking flap extending between, and being in contact with, an adjacent end article and the associated side panel in a carrier formed from the blank, and at least a portion of each upper gusset panel extending between an adjacent end article and the associated locking flap in such a carrier;

each lower end panel flap having an edge separated from the associated locking flap by a slit terminating at a point within the associated locking flap; and said second locking flap fold line extending from said point within the associated locking flap toward the fold line connecting the associated lower end panel flap to the associated side panel section.

4. A blank as defined in claim 3, wherein each side panel section includes an intermediate score line extending across the panel section into the associated lower end panel flaps.

* * * * *